US007766595B2

(12) United States Patent
Lehmann et al.

(10) Patent No.: US 7,766,595 B2
(45) Date of Patent: Aug. 3, 2010

(54) DEVICE AND PROCEDURE FOR TWISTING A COIL INTO PERFORATIONS OF FLAT COMPONENTS

(75) Inventors: Hartmut Lehmann, Nürtingen (DE); Gunnar Vieth, Grossbettlingen (DE)

(73) Assignee: Kugler-Womako GmbH, Nürtingen (DE)

( * ) Notice: Subject to any disclaimer, the term of this patent is extended or adjusted under 35 U.S.C. 154(b) by 1032 days.

(21) Appl. No.: 11/121,186

(22) Filed: May 4, 2005

(65) Prior Publication Data

US 2005/0258588 A1 Nov. 24, 2005

(30) Foreign Application Priority Data

May 4, 2004 (DE) ..... 10 2004 022 246

(51) Int. Cl.
*B21F 45/00* (2006.01)
*B21F 99/00* (2006.01)
*B42C 9/00* (2006.01)

(52) U.S. Cl. ..... 412/39; 140/92.93; 412/9

(58) Field of Classification Search ..... 412/9, 412/34, 38–40; 140/92.4, 92.93, 92.94, 92.9
See application file for complete search history.

(56) References Cited

U.S. PATENT DOCUMENTS 2,101,804 A * 12/1937 Bidwell ..... 140/92.93
2,112,991 A * 4/1938 Madden ..... 140/92.93
2,168,865 A * 8/1939 Fischer ..... 140/92.93
2,177,054 A 10/1939 Catini
2,638,609 A * 5/1953 Penner ..... 140/92.3
3,134,406 A * 5/1964 Freundlich et. al. ..... 140/92.3
4,378,822 A * 4/1983 Morris ..... 140/92.3
6,033,171 A * 3/2000 Doyle et al. ..... 412/39
6,056,495 A * 5/2000 Doyle et al. ..... 412/39
6,851,907 B2 * 2/2005 Spiel et al. ..... 412/40

FOREIGN PATENT DOCUMENTS

JP 2002337474 A 11/2002

* cited by examiner

*Primary Examiner*—Dana Ross
*Assistant Examiner*—Kyle Grabowski
(74) *Attorney, Agent, or Firm*—Venable LLP; Robert Kinberg; Steven J. Schwarz

(57) ABSTRACT

Described is a device and a procedure to twist a coil into perforations that are provided in the margin sections of flat components, sheets of paper in particular, with a drive that causes the rotation and axial in-feed of the coil, corresponding to the inclination of its helix shape. With a stopping device the coil is inhibited from moving further and a release brings the coil out of contact with the stopping device and into contact with the drive.

15 Claims, 3 Drawing Sheets a b b a

DEVICE AND PROCEDURE FOR TWISTING A COIL INTO PERFORATIONS OF FLAT COMPONENTS

CROSS-REFERENCE TO RELATED APPLICATION

This application claims the priority of German Patent Application No. 10 2004 022 246.0-26, filed on May 4, 2004, the subject matter of which is incorporated herein by reference. The disclosure of all U.S. patents and patent applications mentioned below are also incorporated herein by reference.

BACKGROUND OF THE INVENTION

The invention pertains to a device for twisting a coil into perforations that are provided in the margin sections of flat components, sheets of paper in particular, with a drive that causes the rotation and axial in-feed of the coil, corresponding to the inclination of its helix shape. Furthermore the invention pertains to a procedure to twist a coil into perforations that are provided in the margin section of flat components, sheets of paper in particular, in particular using a device such as the one mentioned above.

A device such as the one mentioned above is usually part of a semi or fully automatic system for the production of pads of paper that are held together with coils. In such systems sheets of paper are made of a paper web by cutting, whereupon during this production step the sheets of paper are simultaneously perforated in a margin section by means of a perforation device and imprinted in a printing machine if necessary. Afterwards these sheets of paper are overlapped and gathered into pads of a specific number of sheets of paper. Thereby the sheets of paper are stacked in such a way that the perforated margin sections are aligned to each other. The latter is important for twisting the coil through the perforations of all sheets of paper during the binding process of the paper pads in the successive binding device. The above-mentioned device and procedure are implemented in this last mentioned production step.

Such a device and procedure are for example revealed in DE 1 801 965 A1. This conventional device includes three cylinders along the length of the stack of sheets of paper to be bound. Thereby the first and second cylinders are activated and run inside a protected casing, as a third cylinder with a smooth surface acts as a supporting cylinder for the coil that is driven at the periphery. The casings that contain the first and second cylinders have two functions: (i) they have to guide the coil and (ii) hold the stack of paper sheets together between the perforations to stop them from fanning out. This known device is meant for wire coils and is constructed in a relatively complicated way.

U.S. Pat. No. 2,101,804 describes a similar device, that includes as well three cylinders that stretch out over the entire length of the book to be bound. Thereby two cylinders with concentrical, closed notches on their surface that run in peripheral direction, are activated, while a third cylinder with a smooth surface serves as supporting cylinder for the coil.

Regarding the mechanism described above the coils are first twisted into the perforations of the pre-cut layers of paper and then cut to the desired length. However, such a procedure can lead to handling problems, in particular when using plastic coils.

SUMMARY OF THE INVENTION

The function of the invention on hand is to improve a device and procedure of the above-mentioned kind in such a way that a trouble-free synchronized handling of coils, that are precut to a certain length, in particular plastic coils, is possible.

To solve this problem it is suggested according to a first aspect of the invention that a device twists a coil into perforations that are provided in the margin sections of flat components, sheets of paper in particular, with a drive that causes the rotation and axial in-feed of the coil, corresponding to the inclination of its helix shape and characterized by a stopping device for contact with the coil to stop the coil from moving further, and a releasing device which brings the coil out of contact with the stopping device and in contact with the drive.

Regarding a second aspect of the invention, a procedure is suggested that twists a coil into perforations that are provided in the margin sections of flat components, sheets of paper in particular, specifically by using the aforementioned device with the following steps:

- transport a coil up to the stopping device,
- bring the coil in contact with the stopping device and stop its movement,
- bring the coil out of contact with the stopping device and at the same time in contact with a drive,
- by using the drive, cause the rotation and at the same time an axial in-feed of the coil, corresponding to the inclination of its helix shape, and
- twist the coil into the perforations of the margin sections of the stacked up flat components.

The invention allows for the use of coils that are precut to a desired length. Thereby the stopping device that is provided by the invention assures that only one coil is handled at a time and twisted into the perforations of the stack of flat components, that is positioned on the outlet side of the machine. This is of particular advantage when using plastic coils. Thus the invention allows a synchronized twisting of coils and is especially suited for a fully automated facility. Therefore less labour is needed and the invention thus leads to an increased production.

When using plastic coils the synchronized handling of coils that have been precut to the desired length has the additional advantage that the downtime due to stopping the coils with the stopping device can be used wisely for cooling down the plastic coils, because normally the plastic thread used for the previous production of helix-shaped coils has to be heated.

Preferably the stopping device includes a dead stop against which the leading edge of the coil can be placed. A bar on the dead stop lying at an angle, preferably at a right angle to the moving direction of the coil, which can stand preferably and primarily in an upright position characterizing a particularly simple construction.

In an extended version of the aforementioned model the releasing device is formed in a way that it changes the position of the coil in relation to the bar in a way that the bar lies only partly across the width of the coil, to bring the coil out of contact with the stopping device. After contact with the drive the coil can be transported onwards with the combined twisting and in-feed movement without the bar continuing to fulfill its stopping function and insofar interfering. During this operating state the bar lies in each case between two neighbouring threads of the coil. However, since it reaches only partly into the coil an interference with the opposite sections of the coil does not occur any more. So to speak the coil is 'twisted passed' the bar. Thus when using this model it is not necessary to disconnect the coil completely from the bar, which is an advantage regarding motion sequence and construction.

Normally a transportation device leads the coil from an upstream device in which it is produced to the discussed device. Preferably such a transportation device can feature a relatively long guide way to guide the coil in its lengthwise direction, whereby the guide way ends at the dead stop, such that the coil is advanced against the dead stop. When the dead stop features a bar the guide way should adjoin the bar at an angle, preferably at a right angle. It is practical that the guide way is formed as a relatively long guide bar across which the coil can be slid, so that the relatively long guide bar reaches through the coil and therefore the coil hangs with its inner side on the guide bar. For sufficient flexibility of the coil, namely in curved sections as well as through the releasing device, the thickness of the guide bar should be less and in particular considerably less than the inside diameter of the coil.

Preferably the releasing device features a moveable component that grabs the coil to bring it out of contact with the stopping device and into contact of the drive.

Another preferred model is characterized by a drive that features at least a first cylinder on whose casing the coil can be put in position and a grooved bearing with whose notches the threads of the coil can be brought into contact and by the fact that the relative position between the first coil and the bearing is changeable, to grab the coil between itself. Thus it is possible, by changing the relative position, to clamp the coil between the first cylinder and the bearing so that subsequently the drive that is twisting the coil into the perforations of stacked-up flat components by using a combined twisting and feed-in movement can come into effect.

Therefore the releasing device should be coupled with the first cylinder and the bearing to change the relative position to each other and therewith produce the contact of the coil with the drive.

Advantageously the contact element of the releasing device should be formed by the fist cylinder and/or the notched bearing, so that the first cylinder and/or the notched bearing insofar takes on a double function which offers constructive advantages.

Preferably the notched bearing can feature at least one notched cylinder. An extended version of this model is characterized by the fact that this notched cylinder features a number of notches that are arranged in parallel to each other, arranged in a circle and notches whose distance to each other corresponds to the distance of the single windings of the helix-shape of the coil. It is insofar sufficient that the notched cylinder can be rotated freely and does not necessarily require its own drive.

Preferably the notched bearing should be arranged stationary. Therefore only the first cylinder should be moveable in the direction of and away from the notched bearing.

The notched bearing is basically responsible for the axial feed-in movement of the coil, because its threads are guided by the notches. Thus it is sufficient that the opposite first cylinder has a smooth surface, because it is responsible for the creation of the rotation. Therefore the first cylinder should be moved by drives in a rotating manner.

In another preferred model the drive features in addition to the first cylinder at least a second cylinder, on whose casing the coil can be put in position as well and that is always arranged in a fixed relative position to the first coil, so that the first and second cylinder form a pair of cylinders to grab the coil. The first and second coil should be arranged in parallel to each other. Finally the second cylinder should be formed in the same manner as the first cylinder regarding construction and/or bearing. By arranging a second cylinder that corresponds to the first cylinder the contact with the coil is more stable. In addition such a pair of cylinders forms an advantageous arrangement to grab and support the coil, to stretch it against the notched bearing and subsequently submit it to the desired twisting movement.

BRIEF DESCRIPTION OF THE DRAWINGS

A preferred example of the implementation of the invention is explained subsequently. The following figures show.

DETAILED DESCRIPTION OF THE INVENTION

The device 1 shown in the figures with its essential components serves for twisting a coil 2 that was produced from a thread not shown in an upstream device which is also not shown and features a helix-shape. The coil 2 that can be seen in FIG. 1 only schematically in a cross-section is preferably made of a plastic thread consisting of Thermoplast.

Figure 1:
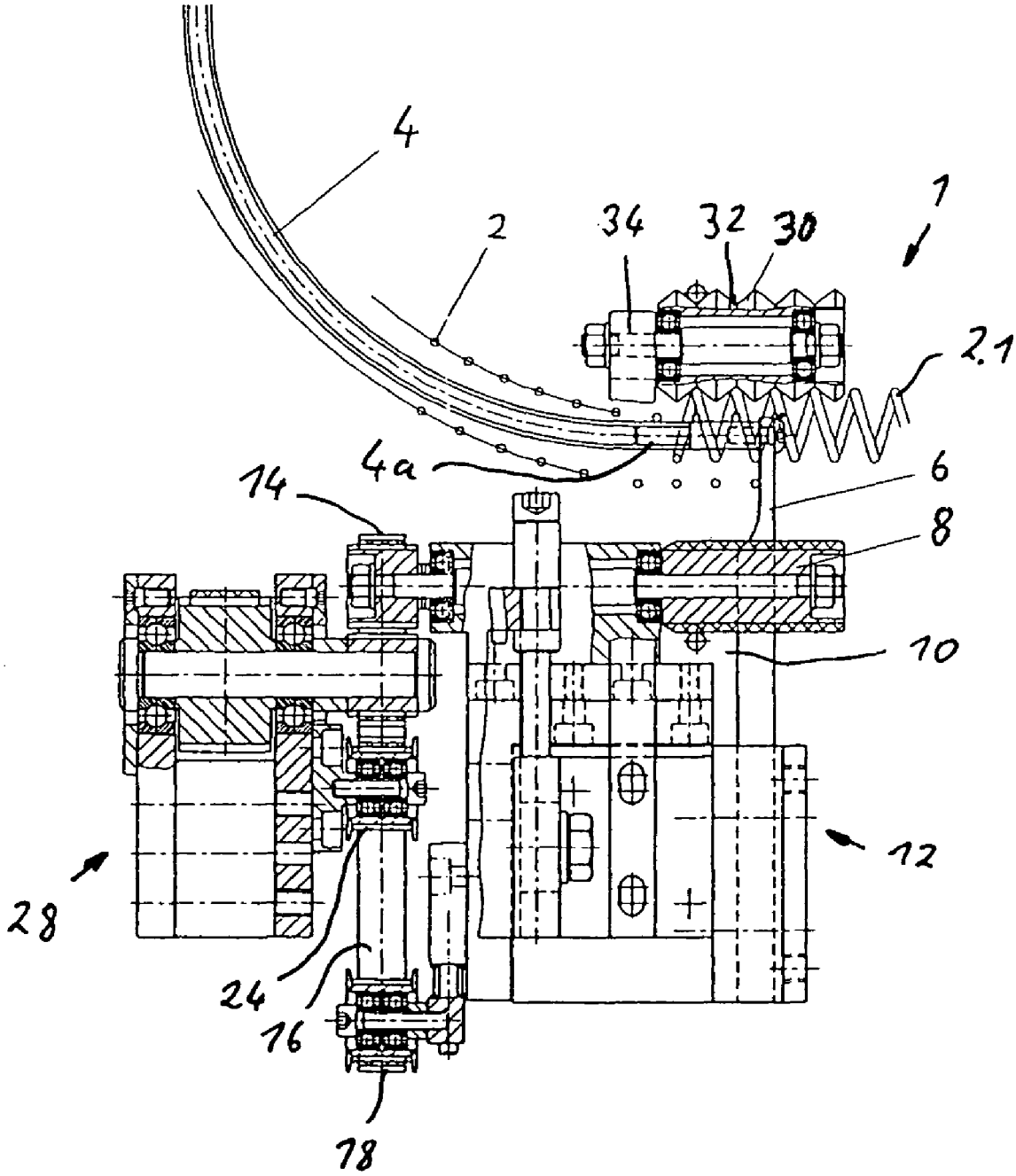
FIG. 1 schematically with a longitudinal section the relevant components of a device for twisting a coil according to a preferred example of the implementation of the invention.

A flexible feed cable 4, that serves as a transportation device for the coil 2 leads from the above mentioned and not shown device, where the coil 2 got its helix shape, to the pictured device 1. Thus the function of the flexible feed cable 4 is that of a guide way for guiding the coil 2. Typically a hydraulic or pneumatic hose, whose fluid is used for other purposes, is used as feed cable 4. Insofar the feed cable 4 takes on a double function in the shown example. As can be seen in FIG. 1 the coil 2 is slid across the feed cable 4, so that the feed cable 4 reaches across the coil 2 and the coil 2 hangs on the feed cable. The diameter of the feed cable 4 is noticeable smaller than the inner diameter of the coil 2 so that the coil 2 can move sufficiently in cross direction. This guarantees a trouble free movement of the coil 2 through curved sections of the feed cable 4.

As shown in FIG. 1 the feed cable 4 adjoins with an end section 4*a* against a bar 6 where it ends. The bar 6 reaches approximately at a right angle to the lengthwise direction of the end section 4*a* of the feed cable 4 and is arranged in the device 1 in a stationary position. The bar 6 serves as dead-stop against which the coil 2 is conveyed via the flexible feed cable. Thus the bar 6 causes an interruption of the movement of the coil 2 so that the coil stops there.

Figure 3:
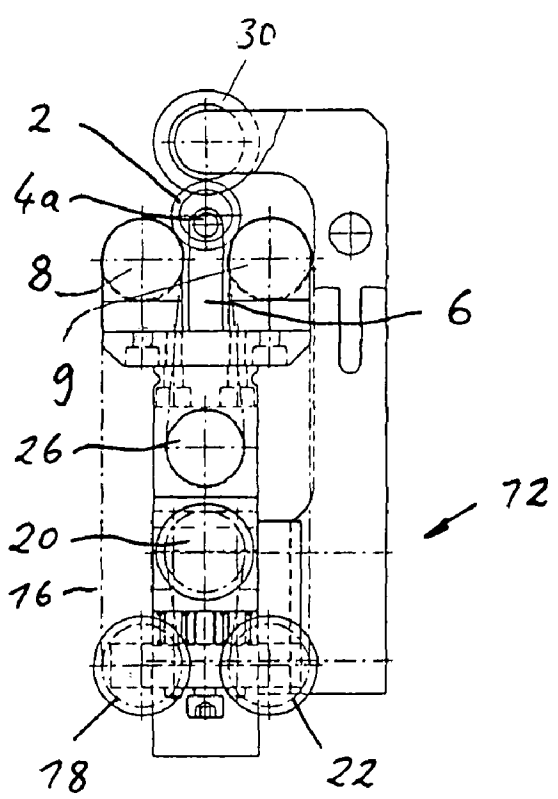
FIG. 3*a* schematically a cross-section of the device of FIG. 1 in an open position as well as FIG. 3*b* schematically a cross-section of the device of FIG. 1 in a closed position.
Figure 3:
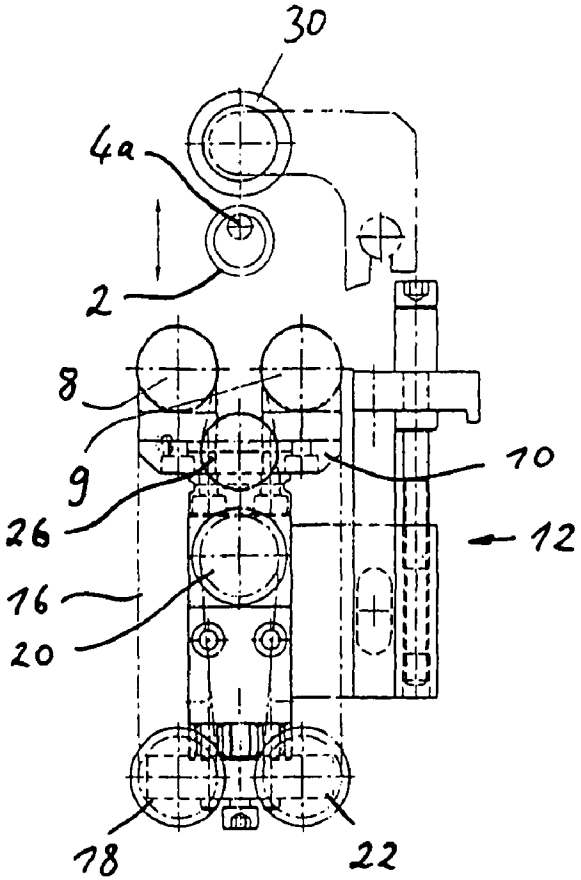

As shown in FIG. 1 in conjunction with FIG. 3*a*, a first cylinder 8 and a second cylinder 9 are provided that are arranged axially parallel to each other as well as at a distance to each other and thus form a pair of cylinders. Both cylinders 8 and 9 have a cylindrical shape with a smooth casing, the surface of which has a rubber coating. Both cylinders are mounted revolvably at a base 10, which is mounted moveably at the device 1 and can be moved by a lifting device 12. The lifting device can move the pair of cylinders 8, 9 in the direction that corresponds to the lengthwise extension of the bar 6. The first and second cylinders 8, 9 are aligned in a way that their axes run approximately in parallel to the lengthwise extension of the end section 4*a* of the flexible feed cable 4 that adjoins the bar 6. Thus the pair of cylinders 8, 9 is moveable at a right angle to their axes through the lifting device 12.

The first cylinder 8 is coupled coaxially and torque proofed with a first reel 14, across which an endless drive belt 16 runs. As shown especially in FIGS. 3*a* and 3*b*, in which the drive belt 16 is indicated only by "dot line, dot line" the drive belt 16 runs from the first reel 8 across a second reel 18, that is mounted rotably on the base 10 that is moveable by the lifting device 12; a third reel 20, that is mounted stationary at the device 1; a fourth reel 22, that is again mounted on the moveable base 10; a fifth reel 24 (see FIG. 2) that is coupled coaxially and torque proofed with the second cylinder 9; and a sixth reel 26 that is again mounted stationary at the device 1 and arranged axially parallel to and with a distance from the third reel 20. The first to sixths reels 14, 18, 20, 22, 24, and 26 are all adjusted axially parallel to each other as well as to the first and second cylinders 8, 9. The sixth reel 26 is coupled with a drive 28 that is as well arranged stationary at the device 1, as shown in FIG. 1. Thus the drive 28, via the drive belt 16, causes the pair of cylinders 8, 9 to rotate.

The first, second, fourth and fifth reel 14, 18, 22 and 24 are arranged with their axes at the corners of an imaginative rectangle while the third and sixth reel 20 and 26 are arranged within this imaginative rectangles among one another and therefore lengthwise to the imaginative rectangle. The result of this special arrangement is that with the aid of the lifting device 12 the base 10, on which the first, second, fourth and fifth reel 14, 18, 22 and 24 are mounted can be shifted between two final positions without having to change the actual length of the drive belt 16. In fact the drive belt 16 is always tightened in this arrangement so that a rotation of the first and second reels 8, 9 with a switched on drive 28 is guaranteed independently of the lift position of the base 10.

FIG. 3*a* shows a first final position of the base 10, in which the pair of cylinders 8, 9 is in a position distant from the feed line and therefore from the coil 2. In contrast FIG. 3*b* shows the base 10 in its second final position, in which the pair of cylinders is in its position neighbouring feed line 4. Since in the example shown the base 10 is moveable in vertical direction by the lifting device 12, the first final position shown in FIG. 3*a* is a lower lifting position and the final position in FIG. 3*b* an upper lifting position.

As FIG. 3*b* also shows the bar 6 is located between the first cylinder 8 and the second cylinder 9. Thus it is possible that the pair of cylinders 8, 9 can move in direction of the lengthwise extension of the bar 6 without colliding with the latter.

A third cylinder is arranged at a distance from the pair of cylinders 8, 9 as a notched cylinder 30 that is aligned axially parallel to the first and second cylinder 8, 9. The notched cylinder 30 has on its outer surface or its casing respectively a number of concentrically circumferential closed notches 32. Thereby in each case the distance between two neighbouring ring-shaped notches 32 is constant and corresponds to the inclination of the coil's helix-shape. Thus each notch 32 grabs in sections a thread of the coil. The notched cylinder 32 is mounted rotably on a bearing element 34 at the device 1. Normally the notched cylinder 30 is arranged stationary during operation. In the example shown, as especially shown in FIG. 2, the bearing element 34 is formed as a bracket and can be arranged swivel-mounted at the device 1. Thus it is possible to swivel the notched cylinder 30 out of the way for maintenance or exchange.

When the pair of cylinders 8, 9 is lifted with the aid of the lifting device 12 from their lower first setting as shown in FIG. 3*a* to their upper second setting as shown in FIG. 3*b*, the pair of cylinders comes into contact with the coil 2 that still adjoins the bar 6 with its preceding section. Thus the coil 2 lies on the pair of cylinders 8, 9. With continuous upwards lifting movement the pair of cylinders 8, 9 picks up the coil 2 so that it does not hang any more at the end section 4*a* of the flexible feed line 4, as shown in FIG. 3*a*. Instead it is disconnected and lifted by the feed line as shown in FIG. 3*b*. When the pair of cylinders 8, 9 reaches its upper second position as shown in FIG. 3*b*, the coil that lies on the pair of cylinders 8, 9 at the same time comes into contact with the above lying notched cylinder 30, because the sections of the single windings are gathered by the notches 32. Thus the coil 2 is clamped between the first and second cylinders 8, 9 and the notched cylinder 30. This state cannot only be seen in FIG. 3*b* but also in FIG. 1 in an illustration of the coil in uninterrupted lines that are marked with the reference symbol 2.1.

At the latest when the pair of cylinders 8, 9 has reached its upper second position as shown in FIGS. 1 and 3*b* the drive 28 is switched on, causing the pair of cylinders 8, 9 to rotate. Thus the coil 2.1 is put into rotation as well, because between the first and the last cylinders 8, 9 and the coil, whereas the coil 2.1 at the same time takes on an axial in-feed corresponding the inclination of its helix shape. Since the coil 2.1 has been lifted with the upward moving pair of cylinders 8, 9 unlike the bar 6, the bar 6 does not reach any more across the total cross section of the coil 2 but only partly. Since the coil 2 has been lifted up by the cylinder pair 8, 9 compared to the bar 6 the bar does not reach any more across the entire section of the coil 2, but only partly. This is clearly shown in FIG. 1 by a comparison between the coil 2 that is shown as a cross section and the lifted coil 2.1 that is shown in a solid line. Thereby the coil overcomes the bar 6 when set into rotation by the pair of coils 8, 9. Since the bar 6 in this way interferes only on one side (as shown in FIG. 1 lower) of the coil 2.1. Between its threads the coil 2 screws along the bar 6, whereby the bar 6 looses its function as a dead stop.

For the sake of completeness, it has to be mentioned that the first and second cylinder 8, 9 together with the notched cylinder 30 form a so-called three-jaw chuck in the closed state, when the cylinder pair 8, 9 is located in the second upper position as shown in FIG. 3*b*.

Figure 2:
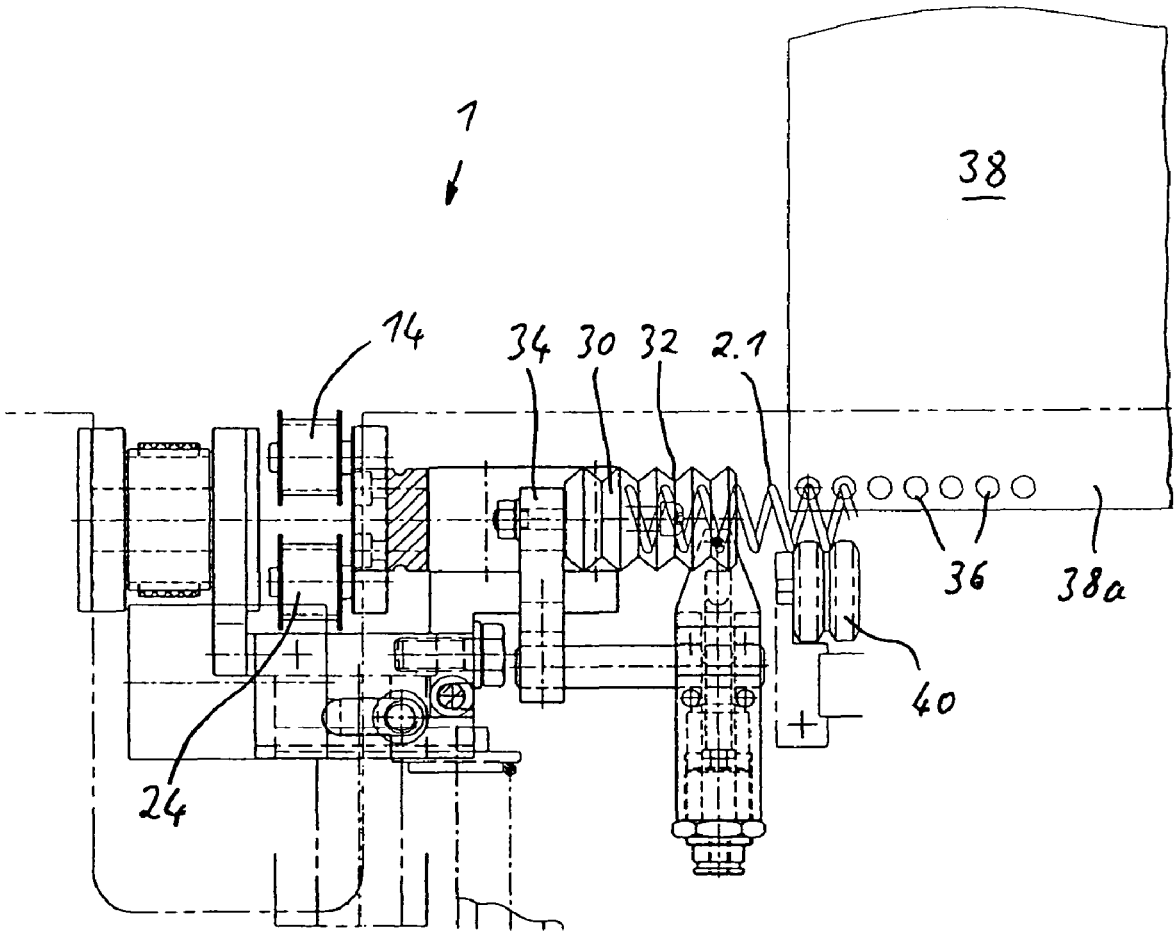
FIG. 2 a partially dissected view in relation to FIG. 1 rotated by 90°.

As shown in FIG. 2 the coil 2.1 is twisted into a number of perforations 36 that are pre-cut in a margin section 38*a* of a stack of paper 38 after it left the notched cylinder 30 and thereby also the pair of cylinders 8, 9. Thereby the stack of papers 38 with its margin section 38*a* is aligned accordingly to the first and second cylinders 8, 9 and the notched cylinder 30. FIG. 1 shows as well that on the outside of the notched reel 30 an opposite notched reel 40 is allowed for additional support in feeding into the perforations 36.

At last it should be mentioned that the shown device 1 is suited very well for the application of coils 2 with varying inclinations and/or diameters. In this case only the notched cylinder 30 and the notched cylinder 40 have to be replaced accordingly.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for twisting a coil having a helical shape into perforations that are provided in the margin sections of flat components stacked one upon another, comprising:

a drive engageable with the coil to subject the coil to rotation and an axial in-feed motion corresponding to an inclination of the helical shape, to twist the coil into the perforations; the drive comprising:

a first cylinder having a shell with a smooth surface positionable against the coil, a second cylinder having a shell with a smooth surface positionable against the coil, wherein the second cylinder is located in a fixed position relative to the first cylinder, and the first cylinder and the second cylinder define a cylinder-pair for reception of the coil, a drive mechanism that drives the first cylinder in a rotating manner, and a notched bearing having notches to contact the threads of the coil, the notched bearing including a freely-turning notch cylinder, wherein a relative position between the first cylinder and the notched bearing is adjustable to receive the coil between the first cylinder and the notched bearing;

a stopping device comprising a bar having a length that lies at an angle with respect to a moving direction of the coil, wherein the bar engages the coil to such an extent that the coil is stopped from being twisted into the perforations; and a releasing device comprising a lifting device that moves the cylinder-pair in a direction parallel to the length of the bar and brings the coil out of engagement with the stopping device to such an extent that the coil is released for further movement and is moved into engagement with the drive to twist the coil into the perforations.

2. The device according to claim 1, wherein the bar comprises a dead stop adapted to contact a leading edge of the coil.

3. The device according to claim 2, further comprising a transportation device for the coil, wherein the transportation device includes a guide way for guiding the coil in its lengthwise direction, where the guide way ends at the dead stop.

4. The device according to claim 3, wherein the dead stop includes a bar that lies at an angle to a moving direction of the coil, and the guide way adjoins the bar at an angle.

5. Device according to claim 3, wherein the guide way comprises a guide bar across which the coil can be shifted.

6. The device according to claim 5, wherein the guide bar defines a thickness that is less than an inner diameter of the coil.

7. The device according to claim 1, wherein the bar stands upright.

8. The device according to claim 1, wherein the releasing device is adapted to move the coil with respect to the bar into a position where the bar runs only partly across the cross section of the coil, to release the coil for further movement.

9. The device according to claim 1, wherein the releasing device comprises a moveable grab element that grabs the coil to bring it at least partially out of contact with the stopping device and into contact with the drive.

10. The device according to claim 1, wherein the releasing device is coupled with the first cylinder and the bearing, and is adapted to change the relative position of the first cylinder with respect to the bearing.

11. The device according to claim 1, further comprising a grab element formed from at least one of the first cylinder and the notched bearing.

12. The device according to claim 1, wherein the notched cylinder includes a plurality of closed notches that are arranged parallel to each other and are ring shaped, wherein a distance between adjacent notches corresponds to an axial length of a single winding of the helical shape of the coil.

13. The device according to claim 1, wherein the notched bearing is arranged stationary, and the first cylinder is adapted to move toward and away from the notched bearing.

14. The device according to claim 1, wherein the first and second cylinder are arranged in parallel to each other.

15. The device of claim 1, wherein the flat components comprise paper sheets.

* * * * *